United States Patent [19]

Pon

BEST AVAILABLE COPY

[11] Patent Number: 4,517,535

[45] Date of Patent: May 14, 1985

[54] HIGH SPEED HIGH POWER STEP ATTENUATOR METHOD AND APPARATUS

[75] Inventor: Chuck Y. Pon, Belmont, Calif.

[73] Assignee: Dalmo Victor Operations, Bell Aerospace Textron, Div. of Textron, Inc., Belmont, Calif.

[21] Appl. No.: 402,622

[22] Filed: Jul. 28, 1982

[51] Int. Cl.[3] ..... H01P 1/22

[52] U.S. Cl. ..... 333/81 A; 333/116; 333/117

[58] Field of Search ..... 333/81 R, 81 A, 117, 333/116, 115, 109, 118, 134, 164, 101, 103, 104

[56] References Cited

U.S. PATENT DOCUMENTS

| | | | |
|---|---|---|---|
| 2,531,419 | 11/1950 | Fox | 333/134 |
| 3,346,823 | 10/1967 | Maurer | 333/117 |
| 3,440,570 | 4/1969 | Kasper | 333/116 |
| 3,775,708 | 11/1973 | Sly | 333/81 A |
| 4,105,959 | 8/1978 | Stachejko | 333/164 X |

*Primary Examiner*—Eugene R. LaRoche

*Assistant Examiner*—Benny T. Lee

*Attorney, Agent, or Firm*—Limbach, Limbach & Sutton

[57] ABSTRACT

A high power, high frequency attenuator which provides attenuation steps which are switchable at very high speed, the attenuator implementing a method by which the input signal is split into two separate signals which are then subjected to impedance mismatches in the signal path, so that a portion of the split signals are reflected back to the signal splitter for dissipation there and the remaining portions of the split signal are transmitted to a summing circuit for recombination and output. The value of mismatch imposed determines the degree of attenuation obtained. The splitting of the signal reduces the stress upon the mismatched components as well as permits high switching speeds of the mismatches in and out of the circuit. In one embodiment of the invention directional couplers are used to provide the signal splitting and recombination functions, with the result that high isolation is achieved between the input port and the reflected signal caused by the mismatches.

17 Claims, 7 Drawing Figures

HIGH SPEED HIGH POWER STEP ATTENUATOR METHOD AND APPARATUS

DESCRIPTION

1. Technical Field

Generally the present invention is directed to attenuation of electromagnetic signals, and particularly to a high speed step attenuator and attenuation method for high frequency, high power signals.

2. Background Art

There has been a long felt need in the microwave frequency art for a step attenuator which is capable of providing attenuation of high power microwave frequencies, in selectable steps, which is switchable between steps at a very high speed.

In the past, there have been several proposed step attenuators, as discussed in a publication entitled "Get Back To Basics With Step Attenuator Design" by Fulvio Ananasso, in MICROWAVES, February 1979, pages 76 through 81.

One of the attenuators discussed in the article involves the use of a pin diode which is employed as a variable resistance element. The pin diode is connected in shunt across a transmission line. A DC biasing voltage is applied to the pin diode in order to select a specific attenuating resistence value. When the pin diode is disconnected from the circuit, by reverse biasing the diode, a capacitance is required in series with the diode in order to resonate the intrinsic inductance and reverse capacitance of the diode out of the circuit. Among the drawbacks of such a configuration is the requirement that (1) the biasing voltage be precise and be compensated over temperature for consistent attenuation characteristics; (2) generation of reflected waveforms back to the input signal source by the mismatch introduced into the circuit by the non-characteristic resistance of the pin diode; and (3) the narrow bandwidth of such a circuit due to the requirement that the intrinsic inductance of the pin diode be resonated out of the circuit.

Another embodiment of attenuator is discussed in the above identified article, one which employs selectable parallel signal paths, one path having no attenuation therein and the other signal path having a matched, resistive attenuation. The switching between signal paths is obtained by appropriately biasing pin diodes into a conducting or non-conducting state. In order to obtain attenuation in steps, several of these parallel signal path circuits could be connected in series, with each of the circuits providing a different degree of resistive attenuation, so that by selecting combinations of the various attenuation factors, the desired total attenuation can be obtained.

One of the drawbacks of such a configuration is the high component count required. For example, at least two pin diodes are required for each signal path, with it being recommended that several pin diodes be used in place of a single pin diode, in order to provide adequate isolation. Additionally, it is recommended that pi or tee networks be used for the resistive attenuation elements. This is based upon the need to avoid any impedance mismatches in the circuit to prevent reflected waves from being returned to the input of the attenuator. These tee or pi networks require a minimum of three resistive components to implement.

A further drawback of this second configuration is that the pin diodes are used as switches therein and are therefore subjected to high power levels. This can lead to component failure, or a shortened component life. The connection of the pin diodes in series with the signal paths renders heat sinking of the diodes difficult, thereby further complicating thermal requirements, such as the maintaining the temperature of the diode junction below a maximum temperature.

A drawback which is common to both of the above discussed attenuator configurations is the speed by which the pin diodes can be switched off and on or from one bias point to another. In the above configurations, the switching time of the pin diodes is often less than satisfactory. This is due, especially in the second configuration, to the high operating signal levels of the various pin diodes. In such a high power operating mode, the intrinsic capacitance of the diode is substantial and as such, there is a bothersome response time between the application of the command to switch between states and the actual switching of the pin diodes between states.

Thus there is a long-felt need for a high frequency, high speed, high power step attenuator in which the component count is reduced, the operating stress upon the components decrease, and the switching time between steps decreased.

DISCLOSURE OF INVENTION

The foregoing and other problems of prior art microwave step attenuators are overcome by the present invention of a high speed, high power step attenuator comprising means for providing signal paths between an input port, a first output port, a second output port and a termination port which splits an input signal presented at the input port into a first split signal and a second split signal, both of substantially equal magnitude. The first split signal is supplied to a first signal path, between the input port and the first output port, and the second split signal is applied to a second signal path, between the input port and the second output port. The first and second signal paths are constructed to impart a phase shift to any signals traveling thereon so as to isolate the input port from any portions of the input signal which are reflected back to the input port due to mismatches at the output ports. The paths between the ports are also arranged so that these reflected waveforms are routed to the termination port for dissipation there. Means are provided for selectively introducing an impedance mismatch at the first and second output ports so that substantially equal portions of the first and second split signals are reflected back into the input signal splitting means and so that substantially equal portions of the first and second split signals are transmitted to a recombining means. These transmitted portions of the first and second split signals are operated upon in the recombining means to be in phase with each other at an output port of the recombining means, so that an additive recombination of the transmitted signals is achieved at the recombining means output port.

The result is a signal which has been attenuated from the magnitude of the input signal to an amount determined by the degree of mismatch introduced at the output of the input signal splitting means. In the preferred embodiment of the present invention the mismatch means comprise resistive elements which are electrically connected to the first and second output ports of the input signal splitting means and which are switched in and out of parallel connection with the first and second output ports by pin diodes. As used hereinafter, in connection with the mismatch means, the term "parallel" shall mean connection in "shunt", i.e, between the subject circuit and ground. In the present invention these pin diodes are operating at a lower signal magnitude than in prior art attenuators, due to the splitting of the input signal between first and second signal paths. As a result of this lower operating magnitude, the pin diodes can be made to switch faster between an off and on state.

Additionally, because the input signal splitting means provides isolation between the first and second output ports and the input port the problem of reflected waveforms due to mismatches in the signal path is solved. Instead of having to contend with reflected waveforms at the input port of the attenuator, as in the prior art, the problem is overcome by routing the reflected waveforms to the termination port for dissipation there.

Furthermore, because the pin diodes are used as high speed microwave switches rather than variable resistive elements, there is little effect on the performance of the attenuator due to temperature variation or aging effects upon the pin diode. Moreover, the component count can be significantly reduced because isolation problems, due to the capacitance of the pin diode, are less pronounced in configuration of the present invention as compared to that of the prior art.

The present invention can handle high signal power levels, first of all, due to the splitting of the signal magnitude equally between two parallel signal paths, and second of all, because in every case, the pin diodes are connected in series with some resistive element so as to further reduce the power handling requirements for each pin diode.

Because the pin diodes are switching resistive elements in parallel with the signal paths of the attenuator, the value of the mismatch, or attenuation, obtained can be controlled precisely by controlling the precision of the resistive elements used. Thus, no special temperature compensated DC biasing circuit is required to set the bias on each pin diode to a precise level. As such, the complexity of the step attenuator is significantly reduced.

It is therefore an object of the present invention to provide a high speed step attenuator for attenuating high power, high frequency signals.

It is another object of the present invention to provide a step attenuator in which the input signal is equally divided between two parallel signal paths into which impedance mismatches are switched to reflect a predetermined portion of the divided signals back to the input port and to permit a predetermined portion of the divided signals to pass through to a recombining means, wherein the signals are recombined for output, and further wherein the signals, which are reflected by the mismatches back toward the input of the attenuator, are routed to a termination port for dissipation, so as to isolate the input port from these reflected waveforms.

It is a further object of the present invention to provide a high power, high speed step attenuator in which the operating power level of individual components within the attenuator is kept low.

It is still another object of the present invention to provide a high power, high speed, high frequency step attenuator having a minimum of components.

It is a still further object of the present invention to provide a step attenuator which can switch between attenuation steps at high speed.

The foregoing and other objectives, features and advantages of the invention will be more readily understood upon consideration of the following detailed description of certain preferred embodiments of the invention, taken in conjunction with the accompanying drawings.

BEST MODE FOR CARRYING OUT THE INVENTION

Figure 1:
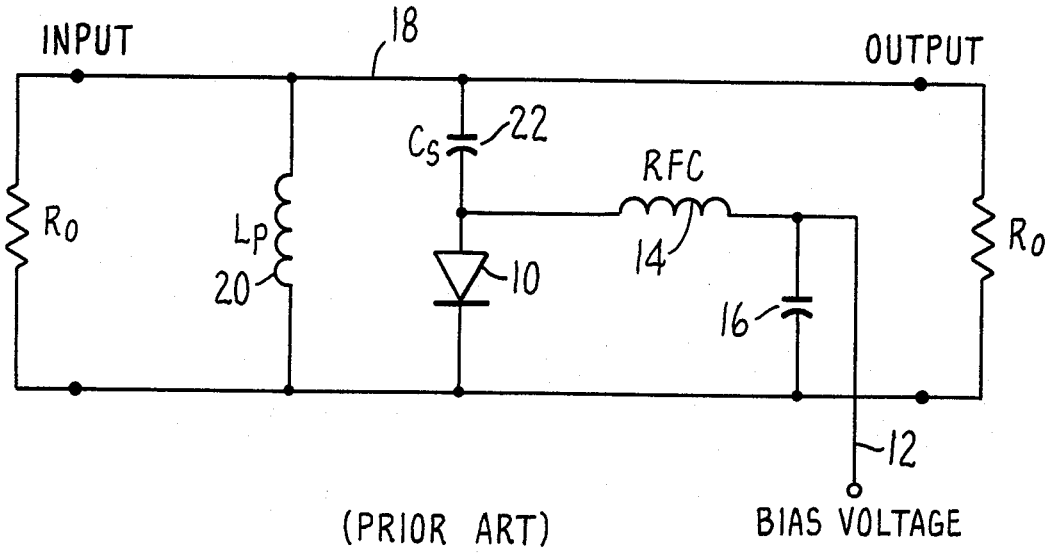
(PRIOR ART) FIG. 1.
FIG. 1 is a schematic of a prior art attenuator.

In FIG. 1 a prior art step attenuator is shown. In this configuration a pin diode 10 is provided with selected magnitudes of bias voltages via line 12, radio frequency choke 14, and bypass capacitor 16. In this manner, depending upon the forward DC voltage applied pin diode 10 can be biased to present a variety of selectable magnitudes of resistance in parallel with the RF signal path 18. In FIG. 1 the characteristic impedance of the RF signal path 18 is $R_o$. Whenever the pin diode 10 is biased for a resistance having a magnitude different from $R_o$, a mismatch is set up in the signal path 18. This causes a portion of the signal, which impinges upon the diode, to be reflected back to the input port with the remainder of the signal being transmitted to the output port. From FIG. 1 it can be seen that no provision is provided for dissipation of this reflected input signal component.

Another drawback of this confirmation is the requirement for precise biasing voltages and a prior knowledge of the bias voltage to resistance relationship of each pin diode. Moreover, temperature compensation is also required to correct for drifts in the diode resistance due to temperature variations.

A further drawback of this configuration is the need to resonate the intrinsic inductance 20 of the pin diode 10 in its off state. Capacitor 22 is shown connected in series with pin diode 10 in order to effectuate this requirement. As a result of this resonant condition, the bandwidth of the configuration is greatly limited.

Figure 2:
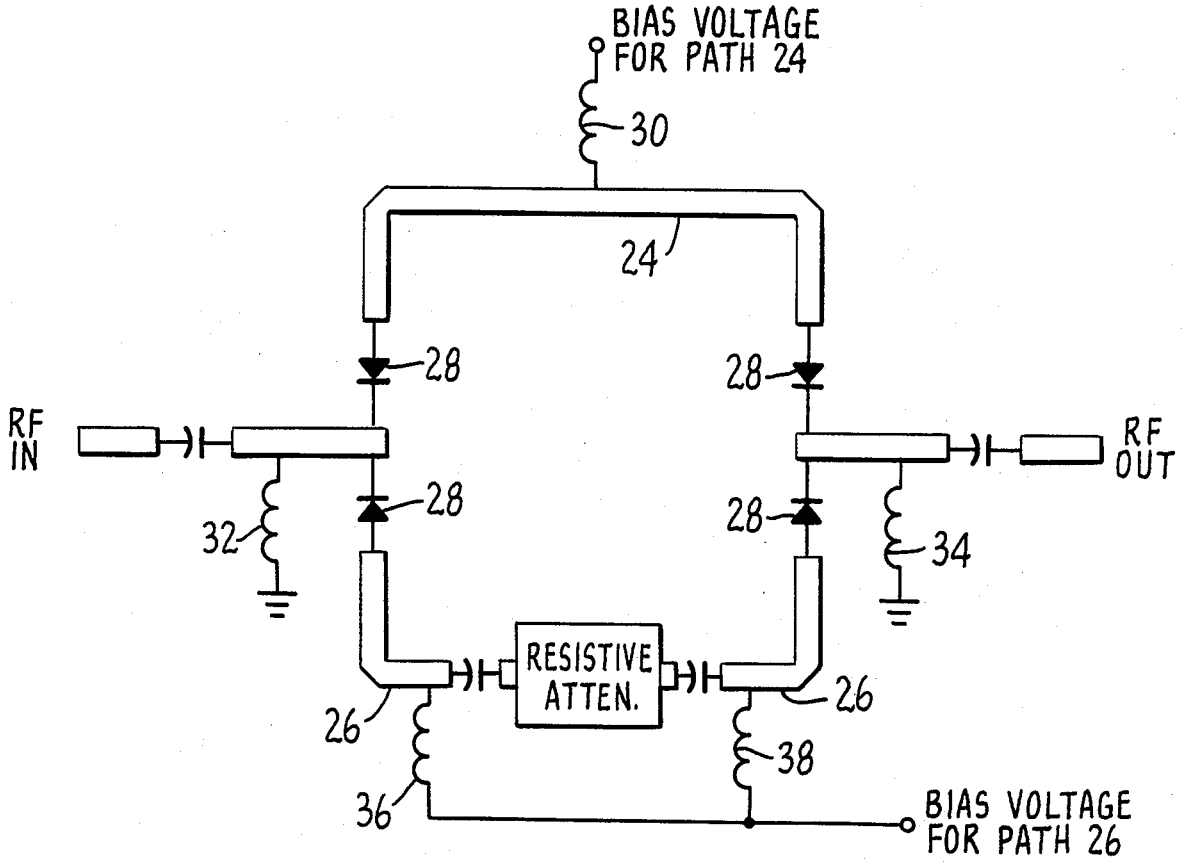
(PRIOR ART) FIG. 2.
FIG. 2 is a simplified schematic of another prior art step attenuator.

FIG. 2 illustrates another prior art step attenuator configuration. In this configuration, the RF signal is switched between one of two signal paths 24 and 26 by way of series connected pin diodes 28. The pin diodes are switched on and off by way of biasing voltages. The biasing voltage to signal path 24 is supplied through radio frequency chokes 30, 32, and 34, while biasing voltages for path 26 are supplied through radio frequency chokes 36 and 32 as well as 38 and 34.

In this configuration, signal path 24 does not provide any attenuation to the input signal, while path 26 provides resistive attenuation in series with the signal path. Typically, this resistive attenuation takes the form of a pi or tee network in order to maintain the characteristic impedance of the signal path, and thus avoid any reflected waveforms.

In the configuration of FIG. 2, it can be seen that the pin diodes in signal path 24 are required to handle the full power of the input signal. As such, the maximum power capable of being handled by such an attenuator is limited by the power dissipation capabilities of these pin diodes. Additionally, because the pin diodes are handling signals of such high power level, switching these diodes from an on to an off state is a significant problem which limits the speed by which the attenuator can be switched from one level of attenuation to the next.

Figure 3:
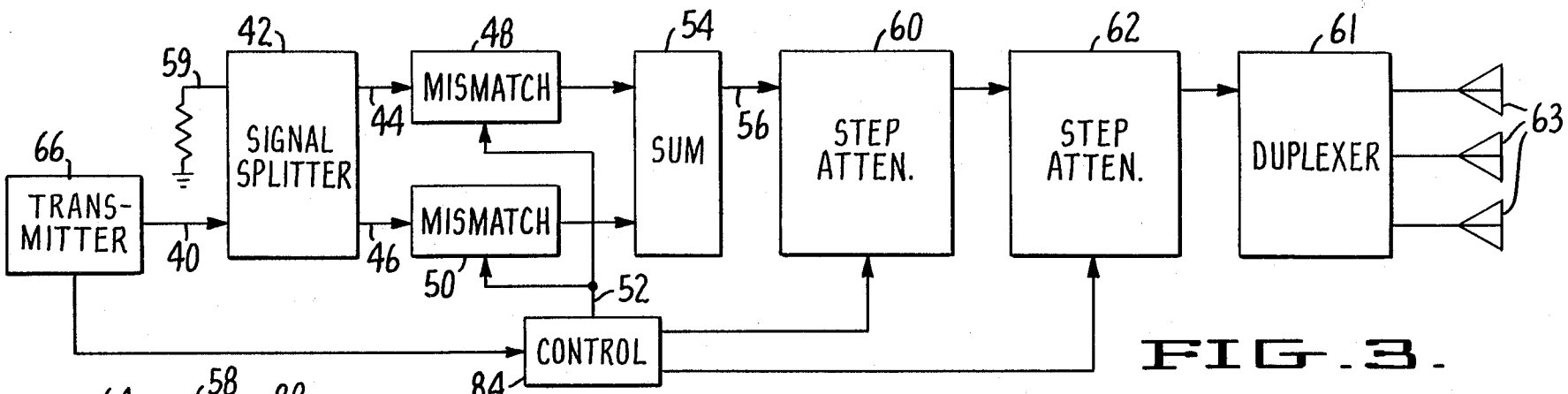
FIG. 3 is a simplified functional block diagram of the present invention.

FIG. 3 is a simplified function block diagram on the present invention. As shown, the present invention is connected in a microwave transmitting system which includes a transmitter 66 as the input signal source, and a duplexer 61 and a number of antennas 63 as the load for the attenuated signal. The transmitter supplies control signals to control circuitry 84 which in turn selects the attenuation desired. The input signal is applied from the transmitter 66 via an input port 40 to a signal splitter 42. The signal splitter 42 divides the input signal into first and second signal of substantially equal magnitude but different phase. The first and second signals are output from the splitter via a first output port 44 and a second output port 46, respectively. Connected to the first and second output ports 44 and 46, are mismatch circuits 48 and 50. These are controlled by signals on lines 52 from control circuit 84 by which the mismatches can be removed or connected to the first and second output ports 44 and 46.

When the mismatches are applied, a portion of the signal emerging from the output ports 44 and 46 are reflected back into the signal splitter 42. The remaining portion of the signal is transmitted to summing circuit 54. Summing circuit 54 operates on the transmitted signals so that they are placed in an in-phase relationship with each other at the summing circuit output port 56. By proper selection of the degree of mismatch introduced by mismatch circuits 48 and 50, a selectable attenuation of the signal can be obtained.

The waveforms which are reflected back into the signal splitter 42 are routed by signal splitter 42 to a termination port 59 where the signals are dissipated in a match load. No portion of the reflected signals appears at input port 40 because the phase relationships of the signal paths within the signal splitter 42 cause the reflected waveforms to cancel one another at the input port 40.

Thus, generally, the present invention implements a method of high power, high frequency, high speed step attenuation by splitting the input signal into two signals having substantially the same magnitude but different phases; by subjecting the signals to a selected mismatch so that a portion of the signals are reflected back towards the input part of the attenuator and the remaining portion transmitted to a summing circuit; by adjusting the phase of the transmitted portions of the signal so that they are in phase with one-another at the output of the summing circuit; by isolating the input port of the attenuator from the reflected waveforms due to the mismatches; and by dissipating the reflected waveforms in a matched, termination load. In one implementation of this method, the mismatches are switched in and out of the signal paths by way of pin diodes.

Figure 4:
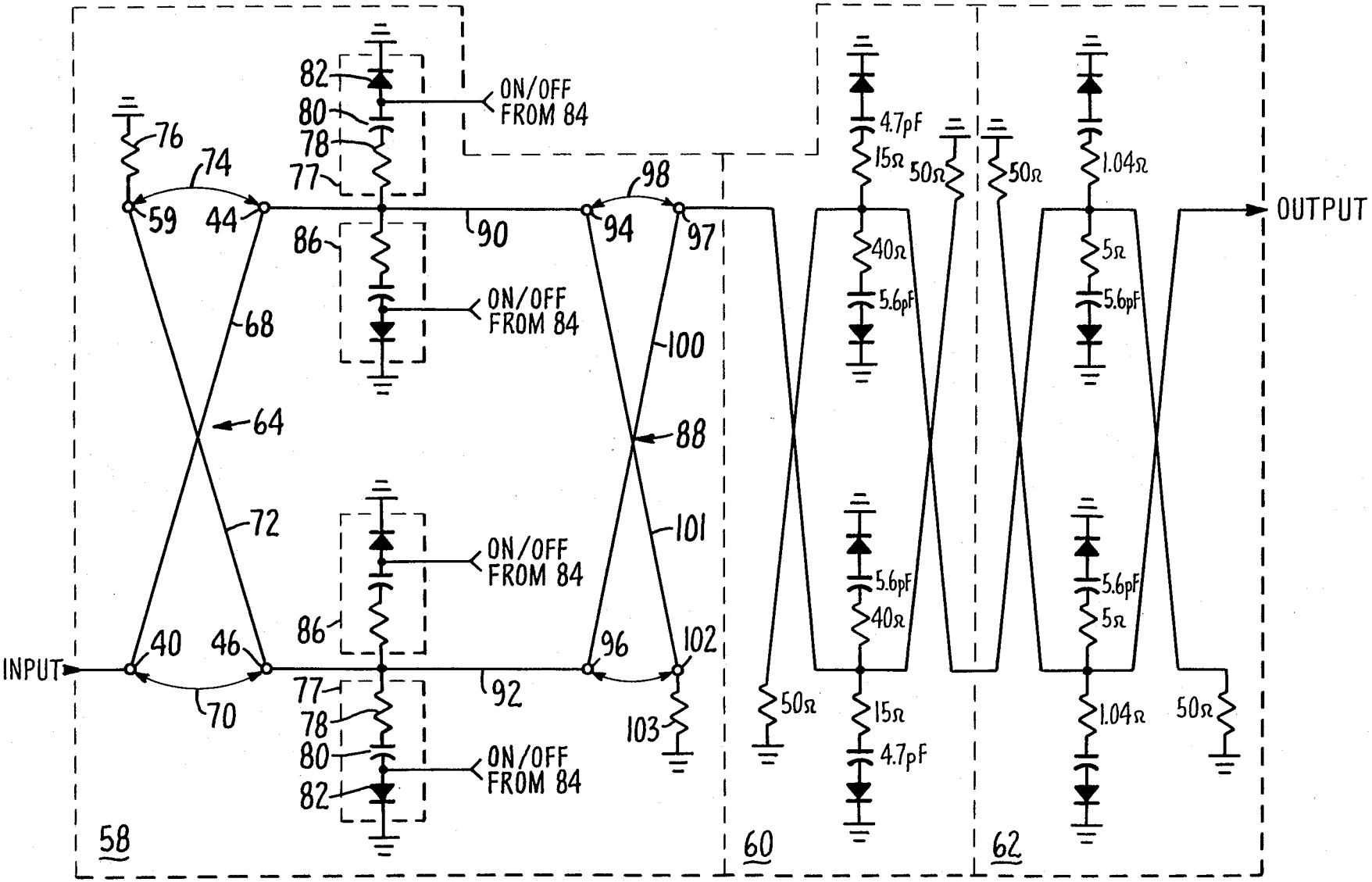
FIG. 4 is a simplified schematic of one embodiment of the present invention.

Referring to the FIG. 4, a more detailed description of the preferred embodiment of the present invention will now be provided. It is to be understood in connection with this more detailed explanation, that the embodiment described is only one of many possible implementations of the teachings of the present invention. For example, there are a number of ways in which to implement the signal splitter 42, the mismatches 48 and 50, or the summing circuit 54, of FIG. 3, which would change the physical structure of the attenuator, but nonetheless implement the teaching of the present invention.

FIG. 4 illustrates an embodiment of the present invention which provides attenuation of high power signals in one decibel (dB) selectable steps from zero dB to 41 dB. In order to achieve this range of attenuation, three stages, 58, 60 and 62, of the basic attenuator circuit are connected in series. A detailed description will be given of the basic attenuator circuit, it being an obvious step to select the mismatch values to form a particular stage in the overall attenuator, as well as to connect the various attenuator stages in series.

Referring to attenuator stage 58, the basic attenuator circuit will be described in greater detail.

Preliminarily, with respect to the embodiment being discussed, it is assumed that the characteristic impedance of the system in which the step attenuator circuit is to be used is 50 ohms. Thus, the signal paths of the step attenuator are designed for a 50 ohm system. It is to be understood where the characteristic impedance of the system in which the step attenuator is located differs, that the characteristic impedance of the step attenuator can be adjusted accordingly.

The Signal Splitter 42

In FIG. 4, it can be seen that the signal splitter 42 of FIG. 3 takes the form of a 3 dB quadrature coupler 64. As is well known in the art, a 3 dB quadrature coupler, such as coupler 64, provides to port 44, via signal path 68, a signal which has been shifted in phase by 90 degrees from the input signal, and reduced in magnitude by 3 dB. Similarly, the signal path shown by arrow 70 provides to output port 46 a signal which has not been shifted in phase with respect to the input signal, but which has a magnitude which is 3 dB below the input signal magnitude. Signal path 68 imparts a 90 degree phase shift by causing the input signal to electrically propagate along a quarter wavelength distance. The signal path 70 between input port 40 and output port 46 takes the form of electromagnetic coupling between signal path 68 and signal path 72, hence there is no phase shift due to such a path.

Signal path 72 connects output port 46 to termination port 59. Signals traveling along this path are shifted in phase by 90 degrees due to the quarter wavelength of the path. The signal path is provided between output port 44 and termination port 59 via the electromagnetic signal path indicated by arrows 74. In both signal paths 70 and 74, the degree of the electromagnetic coupling along each path causes each resulting signal magnitude to be 3 dB below that of the input signal.

In operation, the input signal is introduced at input port 40 and caused to propagate to output port 44 via signal path 68, and to output port 46 via signal path 70. The signal appearing at output port 44 is shifted in phase by 90 degrees and, due to the coupling between signal path 68 and signal path 72, has a magnitude 3 dB below the input signal magnitude. The signal presented to output port 46 is 3 dB below the input signal magnitude but is of the same phase as the input signal.

Upon the presence of a mismatch, i.e. an impedance different from the characteristic impedance of the system, at each of the output ports 44 and 46, a portion of the signal at each of the output ports will be reflected back into the coupler 64. Where the mismatch at each output port is of the same degree, the magnitudes of the waveforms reflected back into the 3 dB coupler 64 will be the same. The reflected waveform into output port 44 will propagate back down signal path 68 to input port 40 and incur an additional 90 degree phase shift. Thus the reflected signal from output port 44 which is presented to input port 40 will be 180 degrees out of phase from the input signal.

The reflected signal into output port 46 will be coupled via signal paths 70 back to input port 40. This reflected waveform will incur no phase shift upon retracing signal path 70, and will therefore be in phase with the input signal. Because the magnitudes of the two reflected waveforms are the same and because the two waveforms are 180 degrees out of phase at the input port 40, they will cancel one-another. The input port 40 is thus isolated from any reflected waveforms which enter output port 44 and 46 as a result of mismatches at these ports.

While the reflected waveforms are self-cancelling at input port 40, signal paths 72 and 74 route these reflected waveforms to termination port 59 for dissipation in a matched load 76. The reflected waveform into output port 44 is coupled via signal path 74 to termination port 59. As explained above, there is no phase shift across this path. Thus, the signal at termination port 59 due to the reflected signal at output port 44 is 90 degrees out of phase from the original input signal. The reflected signal from output port 46 is coupled to termination port 59 via signal path 72. As discussed above, a signal transversing signal path 72 will incur an additional 90 degree phase shift. As such, the signal at termination port 59 due to the reflected waveform from output port 46 will be 90 degrees out of phase from the input signal. Thus it can be seen that the reflected signals presented to dissipation port 59 will be in phase with each other.

Termination load 76, for this embodiment is a 50 ohm load, and is designed to dissipate these reflected waveforms.

Thus it can be seen that by the structure of quadrature coupler 64, input port 40 is isolated from reflected waveforms into output ports 44 and 46, while termination port 59, in conjunction with termination load 76 dissipates all of the reflected waveforms.

The Mismatch Means 48, 50

In this embodiment of the present invention, mismatch means 48 and 50 are provided at output ports 44 and 46 of coupler 64 by way of resistive elements connected in series with pin diode switches. The series combination of pin diode switch and resistive element are applied in parallel to the signal paths. In FIG. 4 two pairs of mismatch elements 77 and 86 are shown connected to output ports 44 and 46 of coupler 64. For purposes of illustration, consider the mismatch element 77 formed by resistor 78, capacitor 80, and pin diode 82. These three components are connected in series. Resistor 78 provides the impedance mismatch to the signal path, while capacitor 80 is a DC blocking capacitor as well as a resonating capacitor. Diode 82, when forward biased, connects resistor 78 in parallel with output port 44. When diode 82 is reversed biased, resistor 78 is taken out of the signal path.

The forward or reverse biasing of diode 82 is performed by driver circuit 83. In the typical application, each mismatch element would have a pin diode switch which is controlled by a driver circuit. These drivers would be contained within a control circuit 84, which in turn receives control signals from the operating system, such as a transmitter 66. See FIG. 3. Each driver circuit would be controlled by the operating system and the output of each driver would be selected by the operating system so that particular combinations of mismatches would be inserted into the corresponding signal paths to produce the desired amount of attenuation.

In the preferred embodiment of the present invention, the pin diode driver provides an initial high current spike to overcome the internal capacitance of the diode, followed by a steady state DC voltage to hold the diode in either a forward biased or reversed biased state. Because in the present invention the operating power levels are significantly lower for the various diode switches, as compared to prior step attenuator designs, the switching speed of the diodes can be significantly improved. In practice switching speeds of better than one microsecond have been achieved where the power of the input signal is on the order of two kilowatts.

The value of capacitor 80 is selected to resonate with the intrinsic inductance of the pin diode 82 in its on state. Due to the series connection of the diode in the mismatch element circuit, the effects of the internal inductance of the diode are not as pronounced as in the circuits of the prior art. Thus, the bandwidth of a step attenuator built according to the teaching of the present invention is at least an octave wide.

As can be seen from FIG. 4, there is a mismatch element disposed at output port 46 which is substantially identical in component value to that disposed at output port 44. This is to provide substantially the same degree of mismatch at each of the output ports 44 and 46 so as to permit the cancellation of the reflected waveforms at input port 40 as discussed above.

In the preferred embodiment of the present invention, a second pair 86 of mismatch elements are positioned at output ports 44 and 46. This mismatch pair 86 provides a different degree of impedance mismatch. In the preferred embodiment of the invention the first pair of mismatched elements utilize a 200 ohm resistive element for a mismatch which provides approximately 1 dB of attenuation, while the second mismatch pair 86 utilizes a 90 ohm resistive element to provide a mismatch which corresponds to approximately 2 dB of attenuation.

In operation, these mismatched elements can be connected into the signal paths either singlely or in combination, to thereby obtain attenuations of 1 dB, 2 dB or 2.8 dB.

The attenuation of a resistor element, R, in parallel with a transmission line with characteristic impedance Ro is given by the equation $$10 \log_{10}\left(4/\left(\frac{Ro}{R}+2\right)^2\right) \text{ dB.}$$

Thus it can be seen that the values of the resistive elements can be chosen for an infinite number of different attenuation values. In the preferred embodiment of the present invention, the resistive elements of the first stage 58 are chosen to provide 1 dB, 2 dB and 2.8 dB of attenuation. The resistive elements of the second stage 60 are chosen to provide 4 dB, 8 dB or 9.8 dB of attenuation. Finally, the resistive elements of the third stage 62 are chosen to provide 14 or 28 dB of attenuation. By connecting combinations of mismatch elements in each of the stages 58, 60 and 62, it can be seen that an attenuator is obtained which provides attenuation in steps of 1 dB in the range of 0 dB to 41 dB.

The Summing Means 54

Returning to stage 58 and FIG. 4, the summing circuit 54 of FIG. 3 is implemented by way of a second 3 dB quadrature coupler 88. This coupler 88 is used in what can be termed a mirror image of coupler 64. The signal transmitted through the mismatch on signal path 90 is received by input port 94 of coupler 88. Recall that the signal on signal path 90 corresponds to the transmitted portion of the signal from output port 44 of coupler 64 which has been subjected to an impedance mismatch by either mismatch element 77 and/or 86. As received by input port 94, the signal is phase shifted by 90 degrees from the original input signal at input port 40 of coupler 64. Input port 96 receives the transmitted signal on signal path 92. Recall that the signal on signal path 92 is in phase with the input signal originally applied to port 40 of coupler 64, and is the transmitted portion of the signal from output port 46 of coupler 64 which has been subjected to the corresponding mismatch combination of mismatch element 77 and/or 86.

As with coupler 64, quadrature coupler 88 provides signal paths which shift the phase of the signals traveling thereon depending upon the ports between which the signals are traveling. As can be seen from FIG. 4, the output port of coupler 88 is selected so that the signal entering the input port 94 will follow signal path 98 and hence, will receive no phase shift. On the other hand, the signal inserted at input port 96 will propagate down signal path 100 and, as a result, be phase shifted by 90 degrees. As a consequence, the two signals will be in-phase at output port 97 of coupler 88. Thus, coupler 88 provides a phase shifting of the input signals and a summation of the phase shifted signals so that the resulting output signal at output port 97 is reduced in magnitude from the magnitude of the input signal applied to input port 40 by an amount of attenuation determined by mismatch elements 77 and/or 86.

Termination port 102 of coupler 88 is terminated in a 50 ohm load. From FIG. 4 it can be seen that there is no signal dissipation in this termination due to the phase relationship of the signals at that port. That is, the signal applied to input port 94 will be shifted by 90 degrees at port 102, while the signal applied to input port 96 will not be shifted in phase. The result is one signal which is phase shifted by 180 degrees from the original input signal at input port 40, and another signal which is in phase with the original input signal at input 40 such that the two signals cancel each other at termination port 102 of coupler 88.

Figure 5B:
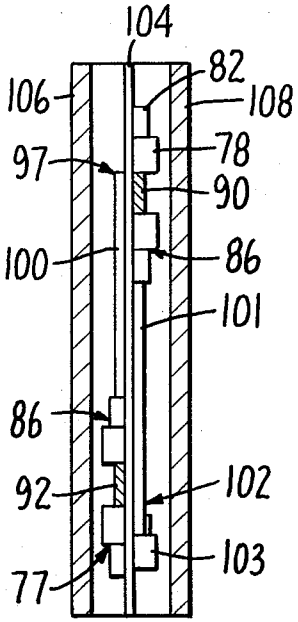
FIG. 5B is a side view of FIG. 5 taken along lines 5B—5B, including ground planes.
Figure 5:
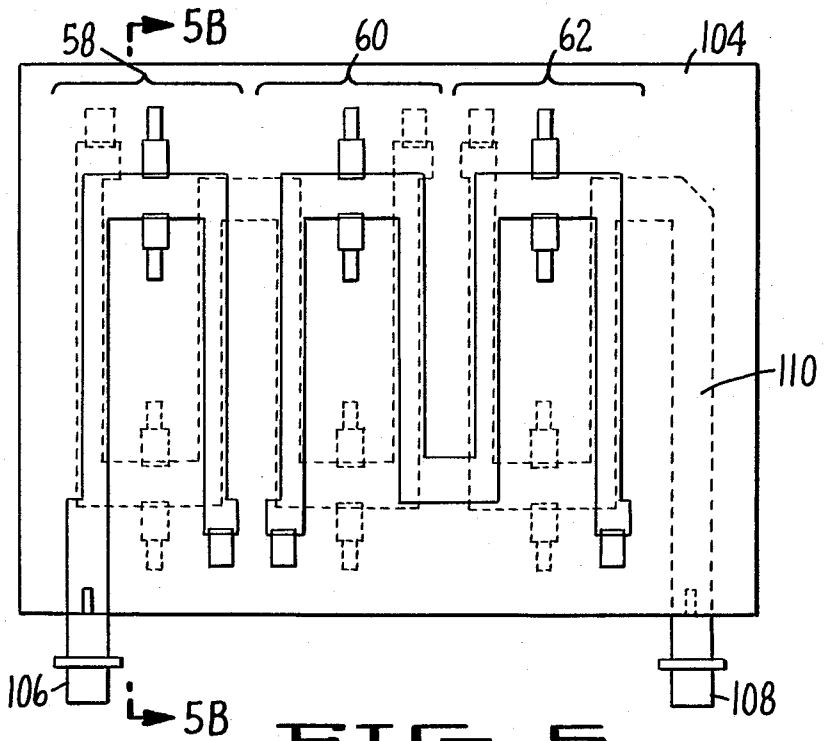
FIG. 5 is a top view of a simplified physical layout of one embodiment of the present invention.

Referring to FIG. 5, a physical implementation of one embodiment to the present invention will now be described. This implementation utilizes stripline transmission line techniques for use in the 1 GHz frequency range. As can be seen from the figure the three stages of attenuation can be packaged tightly for a small space requirement. In one embodiment of the present invention similar to that shown in FIG. 5, the horizontal dimension is approximately $3\frac{1}{4}$ inches, the vertical dimension is approximately $2\frac{1}{2}$ inches, and the depth is approximately $\frac{1}{2}$ inch.

In the implementation shown in FIG. 5 two sides of a dielectric sheet 104 are utilized, with circuit traces on either side. In FIG. 5, the top view is shown with traces and components found on the top side drawn in solid lines, and with the traces and components found on the bottom of the sheet 104 bottom shown in dashed lines.

FIG. 5B is a side view of the embodiment of FIG. 5 which shows the placement of the ground planes 106 and 108 which form a part of the stripline transmission line. FIG. 5B illustrates the manner in which the signal traces of stripline are position on either side of the dielectric sheet 104, and sandwiched between ground planes 106 and 108.

Figure 5A:
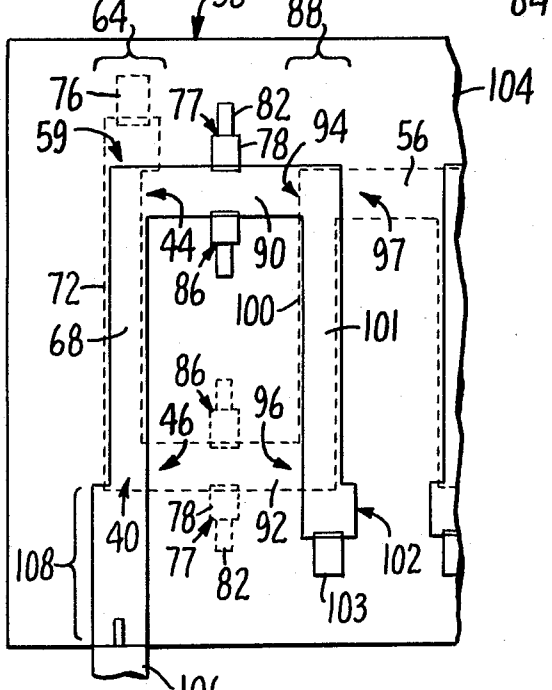
FIG. 5A is an expanded view of one section of the physical layout of FIG. 5.

FIG. 5A is a expanded view of section 58 of FIG. 5. For purposes of illustration, the relative sizes of the various components and circuit traces are exaggerated. As in FIG. 5, traces and components which are found on the top side of the dielectric sheet 104 are drawn with solid lines while the traces and components found on the bottom side of the dielectric sheet 104 are drawn in dotted lines. Additionally, the reference numerals utilized in discussing the schematic diagram of FIG. 4 are also utilized in discussing the physical circuit of FIG. 5A. This is to facilitate the association of the physical components of the embodiment in 5A with the schematic representation of the components in FIG. 4.

Referring to the left side of FIG. 5A it can be seen that the signal splitter 42 of FIG. 3, or the quadrature coupler 64 of FIG. 4, is formed by the trace segment on the top side of the board with reference numeral 68, and the trace segment on the bottom side of the board with reference numeral 72. The input port to quadrature coupler 64 is on the top side of the board and indicated by reference numeral 40. The first output port, from which is obtained the signal which is phase shifted by 90 degrees from the signal at the input port 40, is found at the other end of trace segment 68 and indicated by reference numeral 44.

With respect to trace segment 72 on the bottom side of the board, the second output port, which provides the signal which is in phase with the signal presented at input port 40, can be found aligned with input port 40 and labeled with reference numeral 46. At the other end of trace segment 72 is found the termination port 59. Note that the termination port 59 is disposed beneath the first output port 44. Note also that trace segment 68 is disposed directly above trace segment 72.

In FIGS. 5 and 5A, the top and bottom circuit traces are shown slightly offset from their actual position in the embodiment of the invention. This offset is provided in the drawings to assist in the visual understanding of the relative position of the traces.

The input signal is supplied to input port 40 of quadrature coupler 64 by trace segment 108, which is a length of stripline transmission line having a characteristic impedance of 50 ohms, via a Type SMA connector 106. In practice, connector 106 can be any connector suitable for connecting high frequency signals from a cable or other signal line device to a circuit board trace.

The length of trace segment 68 and of trace segment 72 is selected to be approximately a quarter wave length of the frequency of the signal being attenuated. In the case of the embodiment shown in FIG. 5, a signal of approximately 1 GHz is desired to be attenuated thus indicating a quarter wave length of approximately $1\frac{1}{2}$ inches. By positioning trace segments 68 and 72 in the manner shown in FIG. 5A, both electromagnetic and electrical coupling are obtained between the various ports of the coupler.

An electrical coupling is obtained between input port 40 and outport port 44 as the signal propagates down trace segment 68. Because the trace segment is a quarter wave length long, the signal is shifted by 90 degrees at output port 44.

There is an electromagnetic coupling between input port 40 and output port 46 through the dielectric sheet 104. Because output port 46 is aligned with input port 40, there is no phase shift as the signal is coupled between these ports. There is also an electromagnetic coupling between output port 44 and termination port 59. Because output port 44 is aligned with termination port 59, there is no phase shift as the signal propagates between the ports.

There is, however, a phase shift as the signal propagates electrically between output port 46 and termination port 59 along trace segment 72. This is because the length of trace segment 72 is also a quarter wave length.

The width of both trace segment 72 and trace segment 68, as well as the dielectric material and spacing between trace segments 72 and 68, are chosen so that the signal which propagates electrically along each trace segment and the signal which is coupled electromagnetically between aligned ports have the same magnitude. Thus, for an input signal at port 40 which has a given magnitude, the signal which emerges from port 44 will have a magnitude which is 3 dB lower than the input signal and a phase which is shifted by 90 degrees from the input signal. Similarly, the signal which emerges at output port 46 will have a magnitude which is 3 dB lower than the magnitude of the input signal and a phase which is the same as the input signal.

As discussed above, an advantage of splitting the signal into two separate signals having the same magnitude before actual attenuation is performed, is that the amount of stress to which the attenuating components are subjected is significantly reduced. Additionally, this splitting of the input signal and the phase shifting of one split signal with respect to the other, by way of a quadrature coupler, permits a mismatch type of attenuation to be performed. This is because any reflected signals, due to the mismatches imposed, will be reflected back into the quadrature coupler 64 but phase-shifted by the coupler in such a way that the input port 40 is isolated from such reflected waveform, while the termination port 59 receives all of the reflected wave form magnitude for dissipation of the reflected waveforms there. This isolation and dissipation of the reflected wave forms is based upon the assumption that the reflected waveforms which propagate back through the quadrature coupler 64 to the input port 40 are impressed with a phase and magnitude such that they cancel one another out at the input port 50. Conversely it is assumed that, as the reflected signals propagate back through the quadrature coupler 64 toward the termination port, they are impressed with a phase shift and magnitude such that the sum of the reflected signals at termination port 59 is maximized, for complete attenuation of all of the reflected signals at termination port 59.

It is to be understood that so long as the above discussed isolation and dissipation results occur, it is not necessary that a quadrature coupler be utilized. Thus, any coupler which provides the requisite isolation of the input port from the two output ports with respect to waveforms reflected back into the output ports, and which provides the requisite dissipation of the reflected waveforms, would be satisfactory for use in the present invention. Additionally, it is to be understood that the teaching of the present invention is not limited to splitting the input signal into two equal parts. Rather, it is the concept of reducing the signal magnitudes presented to the attenuating components by splitting the input signal into several parts, however many that may be, which is one of the teachings of this invention.

Remaining with FIG. 5A, the reduced magnitude and phase-adjusted signals which emerge from output ports 44 and 46 of quadrature coupler 64 are propagated along 50 ohm trace segments 90 and 92 respectively. Disposed in parallel with these trace segments are the mismatch circuits described in connection with FIG. 4. At the top of FIG. 5A it can be seen that one end of resistive element 78 is electrically connected to trace segment 90 and that the other end is connected to one end of pin diode 82. The other end of pin diode 82 is connected to the ground plane 108. The illustration of FIG. 5A has been simplified to facilitate the description of the physical embodiment of the invention. As such, the DC blocking capacitor 80 and the connection to the diode driver 84 shown in FIG. 4 have been omitted.

Mismatch circuit 86 is disposed on trace segment 90 opposite mismatch circuit 77. As described in connection with FIG. 4, the value of the resistive element of mismatch circuit 86 is selected to provide a different degree of impedance mismatch than that presented by resistive element 78 of mismatch circuit 77. With respect to trace segment 92, it can be seen that there is a corresponding mismatch circuit 77 and a corresponding mismatch circuit 86 positioned thereon.

In operation, when a mismatch is sought to be introduced in trace segments 90 and 92, the pin diode corresponding to the particular resistive element is forward biased by driver circuit 84. This connects the desired resistive elements in parallel with the trace segments to form a mismatch of impedance in the signal paths. In response to this, a portion of the signals propagating on trace segments 90 and 92 is reflected back to quadature coupler 64 while the remaining portion is permitted to continue on to quadrature coupler 88. Recall that quadrature coupler 88 corresponds to the summing circuit 54 of FIG. 3. As discussed above, the amount of mismatch imposed upon signal paths 90 and 92 determines the amount of attenuation eventually achieved by the attenuation stage. Thus, the selection, either individually or in combination, of mismatch circuits 77 and 86 provides a selectable number of steps of attenuation. In one embodiment of the present invention the resistive element for mismatch 77 is selected to be 96 ohms while the resistive element for mismatch element 86 is selected to be 208 ohms. Connection of mismatch circuit 86 in parallel with trace segments 90 and 92 produces a 1 dB attenuation while connection of the mismatch circuit 77 produces a 2 dB attenuation. Connection of both mismatch circuits 77 and 86 produces a 2.8 dB attenuation. In a similar manner, by selecting the values of the resistive element, one can obtain any degree of attenuation in any step size magnitude desired.

It is to be understood that while resistive elements, such as chip resistors are utilized in the embodiment discussed above, other resistive elements, such as appropriately biased pin diodes can be used satisfactorily with the present invention.

It is also to be understood that while the preceeding discussion has assumed that the quadrature coupler 64 splits the input signal into two signals having equal magnitude, it is also possible to select the mismatch circuits associated with trace segments 90 and 92 such that a signal splitter which produces split signals of different magnitudes can be used. In such a situation, the mismatch circuits would be chosen so that the magnitude of reflection obtained thereby for each trace segment would be set so that there would be a cancellation of the reflected waveform at the input port to the splitter and a total dissipation of the reflected waveforms at the termination port.

If no attenuation is desired, all of the pin diodes associated with the mismatch circuits would be reversed biased so as to remove the resistive elements from parallel connection with trace segments 90 and 92.

The transmitted portion of the signals propagating along trace segments 90 and 92 are received by input port 94 and 96 respectively of quadrature coupler 88. It can be seen from FIG. 5A that this coupler is implemented in much the same manner as quadrature coupler 64. The application of this coupler, however, is reversed from that of quadature coupler 64. Here, the coupler is used to shift the phase of the signal from input port 96 by 90° by causing that signal to propagate down trace segment 100 to output port 97. The signal from trace segment 90, which is received at input port 94, is electromagnetically coupled to output port 97 with no phase shift. As a result, the signal appearing at output port 97 is the sum of the magnitudes of the two signals received at input ports 94 and 96. Termination port 102 of quadrature coupler 88 is terminated by a 50 ohm load impedance. Due to the operation of the coupler, the signals from input port 94 and 96 cancel each other at termination port 102.

The result of the above is that a signal is obtained at output port 97 which is attenuated from that introduced at input port 40 by an amount determined by the selected mismatched circuits 77 and/or 86.

Thus, there is implemented a method of attenuation in which an input signal is first split into two separate signals having magnitudes which are less than the magnitude of the input signal and the sum of which equal the magnitude of the input signal. These signals are then subjected to mismatches as they propagate along a signal path so that a portion of each signal is reflected back to the signal splitter while the remaining portion is transmitted to a summing circuit. The reflected portion of the waveforms are dissipated by the splitting circuit and isolated from the input port. The transmitted portions of the split signals are recombined in the summing circuit and output to the next stage of attenuation. By providing signals having reduced magnitudes to the mismatch circuits, the components utilized in the mismatch circuits are subjected to lower signal levels, and, as such, can be switched in and out of the circuit more quickly. The components are also subject to less chance of component failure due to over stress.

The second and third stages 60 and 62 of the attenuator are implemented in a manner similar to that of attenuation stage 58. The difference between the stages being in the value of the resistive elements selected for each mismatch circuit. Each of the stages is connected in series, with the attenuation of each stage being additive with those of the other stages. In operation, some attenuation may be provided by each of the stages, or all of the attenuation may be provided by one of the stages. Similarly, where no attenuation is desired, none of the mismatch circuits of the three stages are connected in the circuit. The output of the three stage attenuator shown in FIG. 5 is spplied to a type SMA connector 108 via 50 ohm trace segment 110 for output to the remainder of the system. In the embodiment of the present invention, in which one 1 dB steps over a range from 0 to 41 dB are obtained, the value of the resistive elements in stages 60 and 62 are shown in FIG. 4. Also shown are the values of the DC blocking capacitances.

It is to be understood that while the present invention has been explained in terms of stripline transmission lines, other circuit implementations can be utilized with equal success. For example, microstrip transmission lines can be used. The particular circuit medium in which the present invention is implemented is a function of the frequency which is sought to be attenuated.

It is also to be understood that the theoretical frequency and power handling capabilities of the present invention are limited only by the medium in which the invention is implemented. For example, the chip resistors shown in FIG. 5 have limited application at very high frequencies such as 40 GHz. It is conceivable, however, that a resistive element suitable for use at 40 GHz could be found and utilized in the present invention. Similarly, for high power embodiments, the power handling capabilities of the various components would simply be increased.

The above invention thus provides a step attenuator which is capable of handling high power, high frequency signals and which is also capable of switching between values of attenuation at high speed. In doing so, the component count with respect to prior art step attenuators has been reduced, the stress upon each component has been reduced, the speed of switching between attenuation steps has been increased, the size of the overall step attenuator has been decreased, and the overall complexity of the circuit has been significantly reduced.

The terms and expressions which have been employed here are used as terms of description and not of limitation, and there is no intention, in the use of such terms and expressions of excluding equivalents of the feature shown and descripted, or portions thereof, it being recognized that various modifications are possible within the scope of the invention claimed.

I claim:

1. Apparatus for attenuating a high frequency electromagnetic input signal having a predetermined magnitude comprising means responsive to the input signal for splitting the input signal into a first signal and a second signal, each having a predetermined magnitude the sum of which is substantially equal to the input signal magnitude, the input signal splitting means having an input port for receiving the input signal, a first output port for outputting the first signal, and a second output port for outputting the second signal, the input port being isolated from the first and second output ports such that waveforms reflected from the first and second output ports and back into the input signal splitting means cancel one another at the input port and are additive with one another at a termination port for dissipation there;

mismatch means in communication with the first and second output ports for providing selectably connectable impedance mismatches at substantially the same electrical distance from each output port, wherein the impedance mismatch connected at one output port is substantially equal in magnitude to the impedance mismatch connected at the other output port, so that a portion of the first signal from the first output port and a portion of the second signal from the second output port are reflected back into the input signal splitting means for dissipation therein, and so that the unreflected portion of each of the first and second signals are transmitted; and means responsive to the transmitted portion of the first signal and to the transmitted portion of the second signal for recombining the transmitted portions so that the recombined signal corresponds to the input signal, the magnitude of which has been attenuated by a quantity determined by the degree of impedance mismatch provided by the mismatch means.

2. The apparatus of claim 1 wherein the input signal splitting means comprises a first signal path between the input port and the first output port;

a second signal path between the input port and the second output port; and a third signal path between the first output port, the second output port and the termination port;

wherein the first and second signal paths are positioned relative to each other so that the input signal which is applied to the input port is split between the first and second signal paths and shifted in phase by a predetermined amount as it traverses the first signal path, and shifted in phase by a different predetermined amount as it traverses the second signal path, and so that the portions of the input signal which are reflected from the first and second output ports back along the first and second signal paths are shifted in phase so as to cancel each other at the input port, and further wherein, the third signal path is positioned with respect to the first and second signal paths so that the reflected signals from the first and second output ports are routed along the third signal path to the termination port for dissipation there.

3. The apparatus of claim 2 wherein the input signal splitting means includes a first quarter wavelength stripline transmission line which electrically connects the first output port to the input port, and a second quarter wavelength stripline transmission line which electrically connects the second output port to the termination port, the second quarter wavelength transmission line additionally being spaced apart from and aligned with the first quarter wavelength transmission line so that the second quarter wavelength transmission line is electromagnetically coupled to the first quarter wavelength transmission line, and so that the second output port is electromagnetically coupled with no phase shift to the input port, and so that the first output port is electromagnetically coupled with no phase shift to the termination port, the first signal path comprising the first quarter wavelength transmission line so that the predetermined phase shift along the path is substantially 90°, the second signal path comprising the electromagnetic coupling between the second output port and the input port so that the predetermined phase shift therealong is substantially zero degrees, and the third signal path comprising the electromagnetic coupling between the first output port and the termination port, and the second quarter wavelength transmission line.

4. The apparatus of claim 2 wherein the difference between the predetermined phaseshift along the first signal path and the different predetermined phase shift along the second signal path is 90 degrees.

5. The apparatus of claim 1 wherein the input signal splitting means is a quadrature coupler.

6. The apparatus of claim 4 wherein the magnitudes of the first and second signals are each 3 dB below the input signal magnitude.

7. The apparatus of claim 1 wherein the input signal splitting means comprises a first quarter wavelength stripline transmission line having one end electrically connected to the input port and its other end electrically connected to the first output port;

a second quarter wavelength strip line transmission line having one end electrically connected to the dissipating termination port and its other end electrically connected to the second output port;

wherein the second transmission line is positioned in a hypothetical plane which is spaced apart from but parallel to the plane of the first transmission line, so that the input signal is electromagnetically coupled from the input port to the second output port with no phase shift and a magnitude which is 3 dB lower than the input signal magnitude and so that the input signal is electrically coupled to the first output port with a 90 degree phase shift and a magnitude 3 dB lower than the input signal magnitude; and further wherein a first reflected waveform, having a magnitude and a phase, which is inserted into the first output port will be cancelled at the input port by, and dissipated at the termination port in conjunction with a second reflected waveform having the same magnitude as the first waveform and shifted 90 degrees in phase from the first waveform and which is inserted into the second output port.

8. The apparatus of claim 1 wherein the mismatch means comprise a first length of stripline transmission line electrically connecting the first output port to the recombination means;

first resistance means having a predetermined magnitude and selectably connectable in shunt with the first length of transmission line;

a second length of stripline transmission line electrically connecting the second output port to the recombination means;

second resistance means having a magnitude which is substantially equal to that of the first resistance means and selectably connectable in shunt with the second length of transmission line; and means for selecting the first and second resistance means for connection to or disconnection from the first and second lengths of transmission line.

9. The apparatus of claim 8 wherein the first and second resistance means each comprise a chip resistor having a predetermined resistance, and further wherein, the selecting means comprise a first pin diode connected in series with the first chip resistor;

a second pin diode connected in series with the second chip resistor; and biasing means for selectably reverse biasing the first and second pin diodes to rapidly disconnect the first and second resistance means from the first and second lengths of transmission line so that the first and second resistance means are inoperative, and for selectably forward biasing the first and second pin diodes to rapidly connect the first and second resistance means to the first and second lengths of transmission line so that the first and second resistance means are inoperative.

10. The apparatus of claim 1 wherein the recombining means comprises a quadrature coupler having a first input port responsive to the first signal, a second input port responsive to the second signal, an output port, and a termination port, wherein the first input port is electrically connected to the output port and electromagnetically coupled to the termination port, and further wherein the second input port is electromatically coupled to the output port and electrically connected to the termination port, so that the first and second signals are combined within the recombining means for output from the output port.

11. The apparatus of claim 8 wherein the first resistance means include a first plurality of lumped resistance elements each of which is selectably connectable in shunt with the first length of transmission line; and further wherein the second resistance means include a second plurality of lumped resistance elements each of which is selectably connectable in shunt with the second length of tansmission line; each of the first plurality of lumped resistance element having substantially the same values of resistance as corresponding ones of the second plurality of lumped resistance elements so that by selecting corresponding resistance elements from the first and second plurality of resistance elements an impedance mismatch having a selectable magnitude can be created.

12. The apparatus of claim 9 wherein the biasing means comprise a first driver means for driving the first pin diode and a second driver means for driving the second pin diode; each driver means providing an initial high current spike and a subsequent steady state biasing voltage so that the pin diodes can be switched between off and on states with a minimum of delay.

13. Apparatus for attenuating a high power, high frequency electromagnetic signal in a system having a characteristic impedance comprising (a) a first quadrature coupler responsive to the electromagnetic signal including
  (i) an input port for receiving the electromagnetic signal;
  (ii) a first output port electrically connected to the input port by a first quarter wavelength stripline transmission line so that a first signal is produced at the first output port which is shifted in phase by 90 degrees from the input electromagnetic signal;
  (iii) A second output port which is electrically coupled to a termination port by a second quarter wavelength stripline transmission line, wherein the second quarter wavelength of stripline transmission line is electromagnetically coupled to the first quarter wavelength transmission line so that a second signal is produced at the second output port which has the same phase as the input electromagnetic signal, and so that the first and second signals have predetermined magnitudes, the sum of which substantially equals the input electromagnetic signal magnitude, and further wherein whenever a first reflected signal is inserted into the first output port and a second reflected signal is inserted into the second output port, the first reflected signal being shifted in phase by 90 degrees from the second reflected signal and having substantially the same magnitude as the second reflected signal, all of the first and second reflected signal will be dissipated through the termination port and none of the first and second reflected signal will be output from the input port;

(b) a second quadrature coupler which is substantially similar to the first quadrature coupler including
  (i) a first input port corresponding to the second output port of the first quadrature coupler,
  (ii) a second input port corresponding to the first output port of the first quadrature coupler,
  (iii) an output port corresponding to the termination port of the first quadrature coupler, and
  (iv) a termination port corresponding to the input port of the first quadrature coupler, the first input port of the second quadrature coupler being communicatively coupled to the second output port of the first quadrature coupler by a first length of stripline transmission line having the characteristic impedance, and the second input port of the second quarature coupler being communicatively coupled to the first output port of the first quadrature coupler by a second length of stripline transmission line having the characteristic impedance so that the signals from the output ports of the first quadrature coupler are received by the second quadrature coupler, are shifted in phase and recombined in the second quadrature coupler and are output from the second quadrature coupler output; and (c) resistive mismatch means positioned on the first and second lengths of stripline transmission line at substantially the same electrical distance between the first and second quadrature couplers for selectively providing selectably connectable impedance mismatches of substantially equal magnitude between the first and second quadrature couplers, so that a portion of the signal from the first output port of the first quadrature coupler is reflected back into the first quadrature coupler and so that a portion of the signal from the second output port of the first quadrature coupler is reflected back into the first quadrature coupler, wherein the relfected signal portions have substantially the same magnitudes, and so that the remaining signal portions are transmitted into the second quadrature coupler for recombination and output.

14. The apparatus of claim 13 wherein the resistive mismatch means comprise a first plurality of resistive elements each connected in series with a pin diode, wherein each series combination of a resistive element from the first plurality and a pin diode is connected in shunt with the first length of stripline;

a second plurality of resistive elements each connected in series with a pin diode, wherein each series combination of a resistive element from the second plurality of elements and a pin diode is connected in shunt with the second length of stripline;

means for selectively biasing each pin diode so that at any point in time selected ones of resistive elements from the first and second plurality of elements are electrically connected in shunt with the first and second length of stripline respectively, so as to provide a selected degree of mistmatch between the first and second quadrature couplers.

15. The apparatus of claim 14 wherein the selective biasing means comprise a plurality of pin diode drivers, each driver being associated with a different one of the pin diodes, each driver being capable of providing a high current spike followed by a steady state voltage, both of selectable polarity, so that each pin diode can be selectively switched from an on to an off condition and from an off to an on condition with a minimum of delay.

16. An apparatus having a characteristic impedance for step attentuation of a high power microwave input signal comprising (a) first quadrature coupler means including
  (i) an isolated port for receiving the input signal,
  (ii) a 90 degree output port which provides a first signal which is shifted by 90 degrees from the input signal,
  (iii) a zero degree output port which provides a second split signal which is inphase with the input signal, the sum of the magnitudes of the first and second split signals being substantially equal to the magnitude of the input signal, and
  (iv) a termination port which receives reflected signals from the first and second output ports for dissipation in a terminating load;

(b) first mismatch means having a predetermined mismatch magnitude and responsive to the first signal and positioned at a first predetermined electrical distance from the 90 degree output port for reflecting a first selectable portion of the first signal back into the 90 degree output port of the first quadrature coupler, and for transmitting the remaining portion of the first split signal;

(c) second mismatch means having a predetermined mismatch magnitude substantially equal to the mismatch magnitude of the first mismatch means and responsive to the second signal and positioned at a second predetermined electrical distance from the zero degree output port wherein the second predetermined electrical distance in substantially equal to the first predetermined electrical distance for reflecting a second selectable portion of the second split signal back into the zero degree output port of the first quadrature coupler, and for transmitting the remaining portion of the second signal; and (d) second quadature coupler means responsive to the transmitted portions of the first and second split signals, including
  (i) a 90 degree input port responsive to the transmitted portion of the second signal for shifting the second signal portion by 90 degrees,
  (ii) a zero degree input port responsive to the transmitted portion of the first signal,
  (iii) an output port for summing the transmitted portion of the first signal and the phase shifted transmitted portion of the second signal, and
  (iv) a termination port which is terminated in the characteristic impedance.

17. A method for the attenuation of a high frequency, high power electromagnetic input signal in selectable steps comprising the steps of splitting the input signal into a first split signal and a second split signal by way of a first coupler means wherein the first split signal is shifted in pahse from the second split signal by a predetermined amount and both split signals have substantially equal magnitudes, the total of which substantially equals the input signal magnitude;

applying the first split signal to a first selectably connectable impedance mismatch and the second split signal to a second selectably connectable impedance mismatch, both of said impedance mismatches having substantially the same magnitude, each impedance mismatch being positioned at substantially the same electrical distance from the first coupler means, so that a portion of the first and second split signals is reflected and a portion is transmitted to a second coupler means, the first coupler means then dissipating the reflected signal portions internally; and recombining the transmitted portion of the split signal in the second coupler means by phase shifting one of the split signals to be substantially equal in phase to the other split signal and by adding the resulting signals together, the selectable impedance mismatch being selected so that the sum of the magnitudes of the transmitted portions of the split signals corresponds to the input signal magnitude which has been attenuated by the desired amount.

* * * * *